US005148492A

United States Patent [19]

Uzawa et al.

[11] Patent Number: 5,148,492

[45] Date of Patent: Sep. 15, 1992

[54] DIAPHRAGM OF DYNAMIC MICROPHONE

[75] Inventors: Shigeru Uzawa, Tokyo; Yoshio Kikuti, Sagamihara, both of Japan

[73] Assignee: Kabushiki Kaisha Audio-Technica, Japan

[21] Appl. No.: 669,035

[22] Filed: Mar. 14, 1991

[30] Foreign Application Priority Data

May 22, 1990 [JP] Japan ..... 2-53164[U]

[51] Int. Cl.[5] ..... H04R 25/00

[52] U.S. Cl. ..... 381/177; 381/193; 381/202; 181/166; 181/170

[58] Field of Search ..... 381/177, 202, 158, 193, 381/204; 181/166, 167, 170; 29/594

[56] References Cited

U.S. PATENT DOCUMENTS

| | | | |
|---|---|---|---|
| 4,135,601 | 1/1979 | Tsukagoshi et al. | 181/170 |
| 4,140,203 | 2/1979 | Niguchi et la. | 181/166 |
| 4,315,112 | 2/1982 | Hofer | 381/202 |
| 4,847,908 | 7/1989 | Nieuwendijk et al. | 381/202 |
| 4,903,308 | 2/1990 | Paddock et al. | 381/153 |

FOREIGN PATENT DOCUMENTS

| | | | |
|---|---|---|---|
| 0065997 | 4/1982 | Japan | 181/167 |

*Primary Examiner*—Jin F. Ng
*Assistant Examiner*—Huyen D. Le
*Attorney, Agent, or Firm*—Welsh & Katz, Ltd.

[57] ABSTRACT

There is a dynamic microphone comprising: a diaphragm which can vibrate by an acoustic wave and a voice coil which is joined to the diaphragm so as to transverse a magnetic field formed by the magnet and can vibrate integratedly with the diaphragm, wherein a number of peripheral treatment agents for damping are coated in a dot shape or a discontinuous stripe shape at intervals onto either one of the front surface and the back surface of the portion of the diaphragm excluding the center dome. With the above construction, a change in stiffness of the diaphragm by the peripheral treatment agents is extremely reduced, it is prevented that the diaphragm resonates at a special frquency, a sudden attenuation of the low frequency limit is prevented, and a low sound can be also certainly collected.

3 Claims, 4 Drawing Sheets

DIAPHRAGM OF DYNAMIC MICROPHONE

FIELD OF THE INVENTION

The present invention relates to a dynamic microphone for converting an acoustic wave of a voice or the like into an electric signal and, more particularly, to the improvement of a diaphragm of a dynamic microphone in which a damping material is coated and an abnormal resonance of the diaphragm is suppressed.

PRIOR ART

Conventionally, a dynamic microphone in which a voice coil attached to a diaphragm which is vibrated by an acoustic wave which is generated from a sound source is vibrated integratedly with the diaphragm in a gap of a magnetic circuit and a moving velocity of the voice coil is generated as an electric signal has widely been used not only for a business but also in an ordinary home.

FIG. 3 shows a schematic cross sectional view of an example of a dynamic microphone which is generally used. In the diagram, the dynamic microphone mainly comprises: a diaphragm 1; a magnet 2; a voice coil 3; and a casing 4 to which a peripheral edge portion of the diaphragm 1 is joined and which has therein various component elements of the microphone. That is, the cylindrical voice coil 3 is located in a narrow gap G between the outer peripheral surface of a pole piece 5 and the inner peripheral surface of a yoke plate 6. The pole piece 5 is made of a magnetic soft iron and is formed in a disk shape and is joined to the front surface of the magnet 2. The yoke plate 6 is similarly made of a magnetic soft iron and is formed in an almost pan shape and is joined to the rear surface of the magnet 2. At an edge of the voice coil 3, the voice coil 3 is fixed to an outer peripheral portion of a center portion of the diaphragm 1, that is, the outer peripheral portion of a center dome 1*a* of the diaphragm 1. A peripheral edge portion 1*c* corresponding to an outer peripheral edge of an edge portion 1*b* locating in the outer peripheral portion of the center dome 1*a* of the diaphragm 1 is attached to an outer edge portion of a front surface of the casing 4 provided in an outer peripheral portion of the yoke plate 6 by using an adhesive agent. The gap G locating in the voice coil 3 constructs a magnetic circuit together with the pole piece 5, yoke plate 6, and magnet 2. When the diaphragm is vibrated by the acoustic wave from the sound source, the voice coil 3 vibrates integratedly with the diaphragm 1 in the gap G. A current flows through the voice coil 3 in accordance with a velocity by the vibration and a voice signal is obtained by detecting and amplifying the current. In FIG. 3, reference numeral 8 denotes a through hole which communicates the inside and the outside of the casing 4. Reference numeral 9 indicates an acoustic resistive agent arranged in contact with the through hole 8.

In the dynamic microphone which was substantially constructed as mentioned above, it is demanded that a low frequency limit is set to a low frequency, so that it is necessary to devise the diaphragm 1 and voice coil 3. In order to set a resonance frequency to a low frequency, there are methods such that a weight of voice coil 3 is increased, a raw material of the diaphragm 1 is made thin, a shape of edge portion lb of the diaphragm 1 is changed such as to lower the resonance frequency, and the like.

However, when the weight of voice coil 3 is increased, an increase in vibration noise is caused. On the other hand, as shown at frequencies near 5 kHz in a frequency response characteristic graph of FIG. 4 showing 0° characteristics as an example, if the raw material itself of the diaphragm 1 is made thin or the shape of the edge portion 1*b* is changed, an abnormal resonance occurs in a middle high band. Although such an abnormal resonance can be reduced to a certain degree by the shape or the like of the diaphragm 1, determination of such a shape largely depends on experimental elements, so that trial costs are also high and eventually, costs of products are high.

It is considered that causes of the abnormal resonance are mainly based on a thickness and a shape of the edge portion 1*b*. To suppress such an abnormal resonance, a method whereby a peripheral treatment agent 10 is coated onto the whole surface of the edge portion 1*b* has conventionally been used. However, since the peripheral treatment agent 10 is coated onto the whole surface of the edge portion 1*b*, a stiffness of the diaphragm 1 is largely easily influenced. As shown in the 0° characteristics as an example in a frequency response characteristic graph of FIG. 5, although the occurrence of the abnormal resonance is improved, there are problems such that low frequency characteristics of 200 Hz or lower are suddenly attenuated, it is substantially difficult to collect sounds in a low band, the shape of the diaphragm must be changed, and the above method cannot be easily applied to a cheap microphone.

SUMMARY OF THE INVENTION

In order to improve the drawbacks in the conventional techniques mentioned above, it is an object of the invention to provide a diaphragm of a dynamic microphone in which a change in stiffness can be extremely reduced and the occurrence of an abnormal resonance can be suppressed by low costs without changing a shape of an edge portion as compared with the conventional peripheral processing method.

The present invention comprises: a casing; a diaphragm which is arranged in front of the casing and can vibrate in accordance with a vibration from a sound source and is constructed by a center dome as a center portion of the diaphragm and an edge portion as an outer peripheral portion of the center dome; a magnet arranged behind the diaphragm; a pole piece joined between the front surface of the magnet and the diaphragm; a yoke plate which was joined to the rear surface of the magnet; a voice coil which is arranged in a narrow gap between the outer peripheral surface of the pole piece and the yoke plate and is joined to the diaphragm so as to transverse a magnetic field formed by the magnet and can vibrate integratedly with the diaphragm; and damping means which is constructed in a manner such that a number of peripheral treatment agents are coated in a dot shape or a discontinuous stripe shape at intervals onto either one of the front surface and back surface of the portions of the diaphragm excluding the center dome portion.

In the diaphragm as mentioned above, since the peripheral treatment agents are coated to the portions of the diaphragm excluding the center dome portion, that is, the edge portions discontinuously like a dot or stripe shape, a change in stiffness of the diaphragm by the peripheral treatment agents is extremely small, it is prevented that the diaphragm resonates at a special frequency, a sudden attenuation of the low frequency limit is prevented, and a low sound can be also certainly collected.

EXPLANATION OF THE PREFERRED EMBODIMENT

An embodiment of the invention will be described in detail hereinbelow with reference to the drawings.

In the following description, since a dynamic microphone itself excluding a diaphragm is the same as that of the conventional example mentioned above, the drawings and the detailed explanation are omitted.

Figure 1:
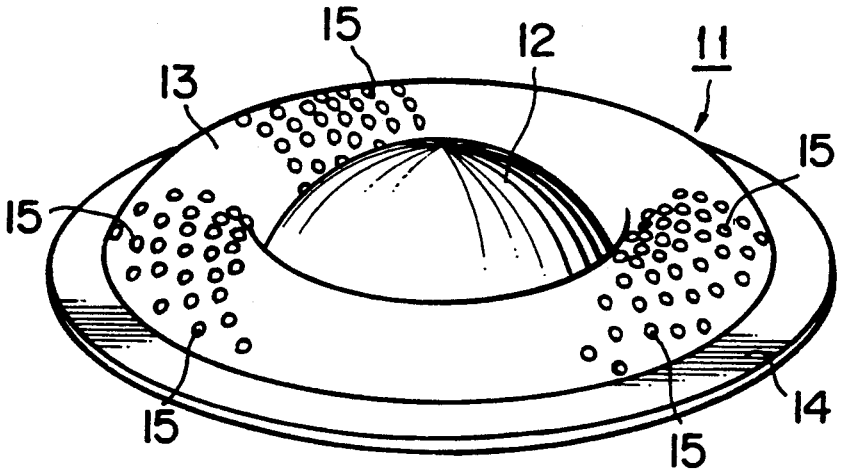
FIG. 1 is a perspective view showing enlargedly a part of a diaphragm of a dynamic microphone according to an embodiment.
Figure 3:
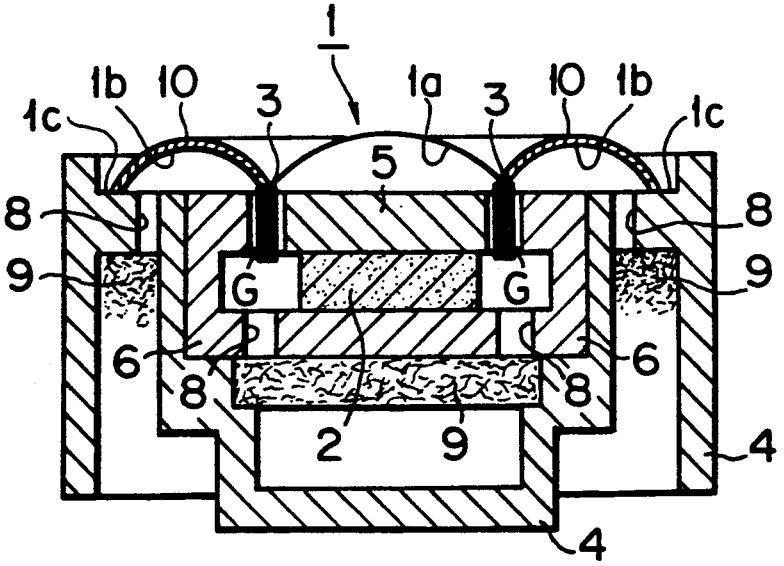
FIG. 3 is a cross sectional view showing a schematic structure of a dynamic microphone according to a conventional example.
Figure 2:
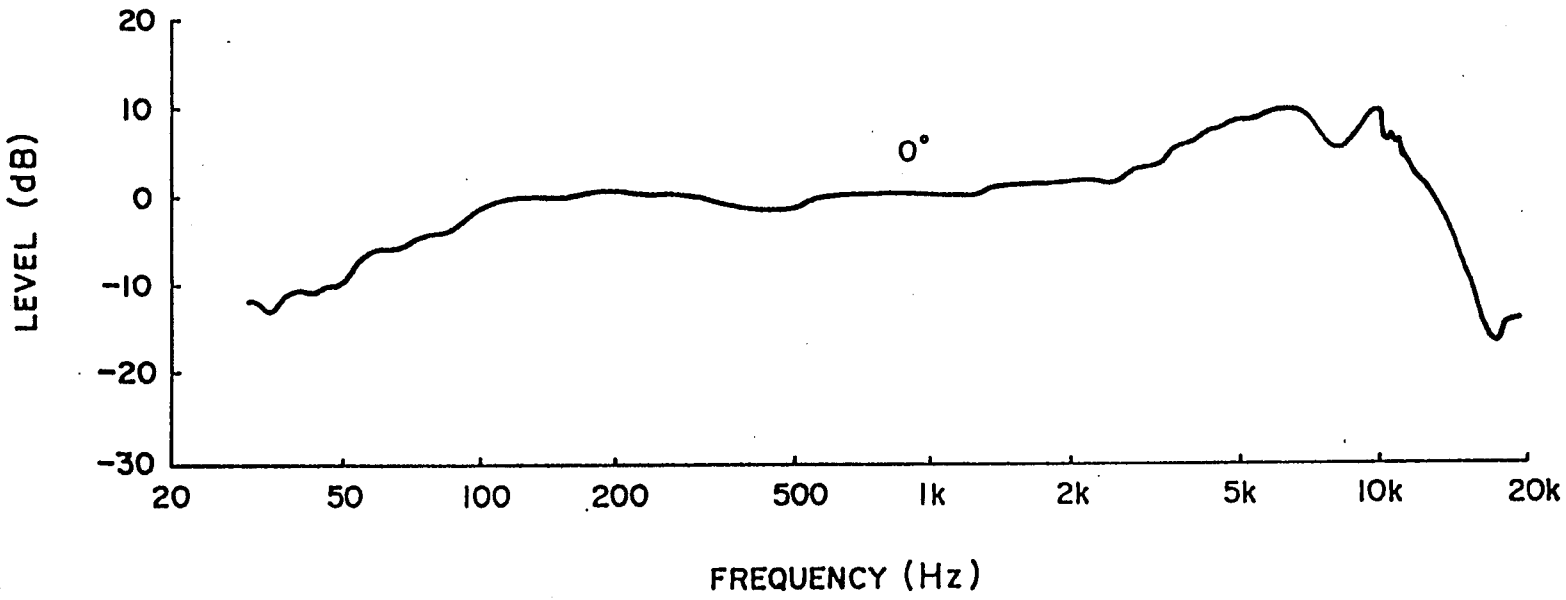
FIG. 2 is a characteristic graph showing frequency response characteristics of the dynamic microphone according to the embodiment.
Figure 4:
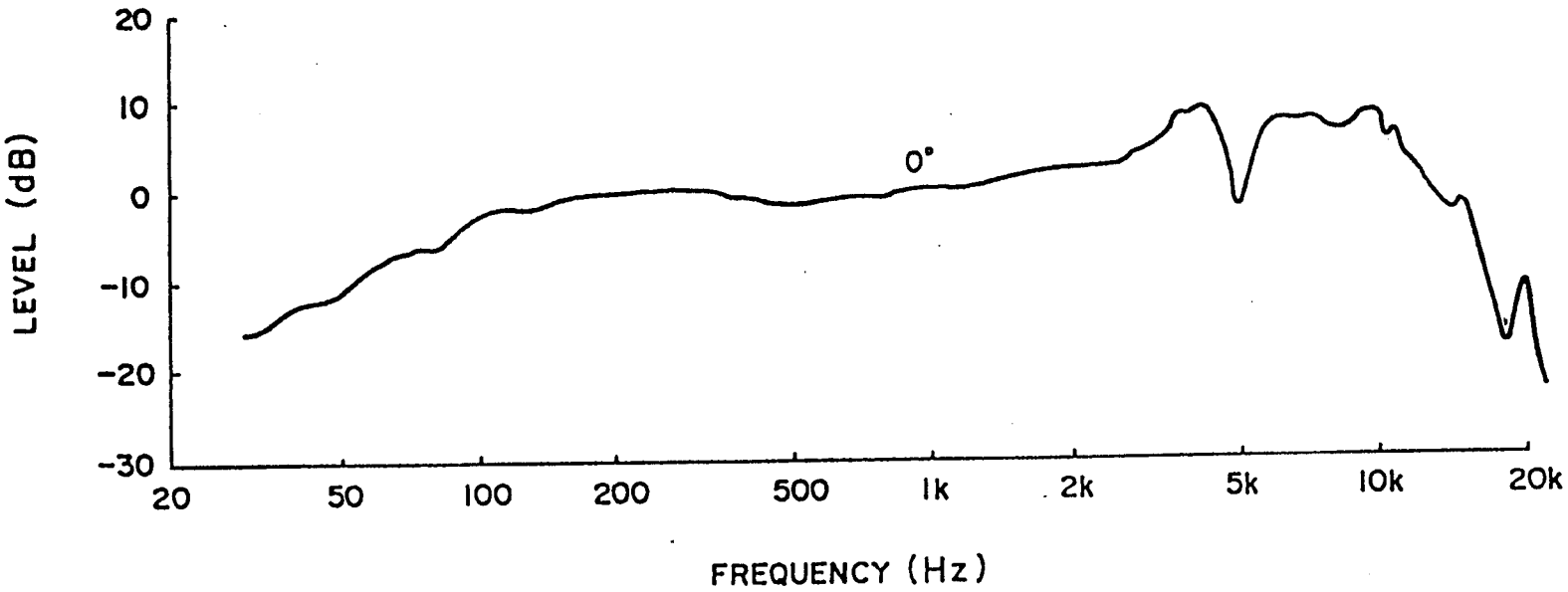
FIGS. 4 and 5 are frequency response characteristic graphs of the dynamic microphone according to the conventional example.
Figure 5:
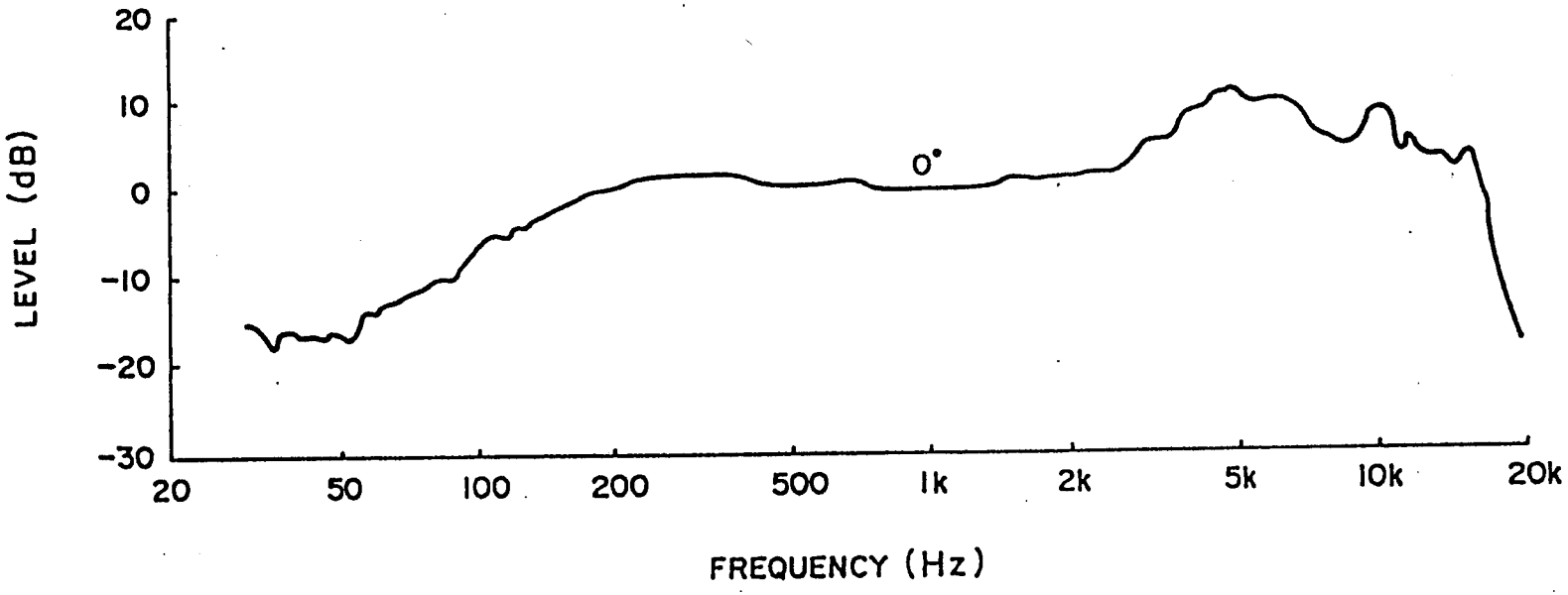

FIG. 1 is a perspective view showing a diaphragm according to an embodiment of the invention. A diaphragm 11 has a center dome portion 12 at a center in a manner similar to the conventional example and a doughnut shaped edge portion 13 is formed in an outer peripheral edge portion of the center dome portion 12. A flat peripheral edge portion 14 is formed in an outer peripheral edge of the edge portion 13 integratedly with the edge portion 13. The peripheral edge portion 14 is fixed to the outer edge portion of the front surface of the casing 4 provided in the outer peripheral portion of the yoke plate 6 in FIG. 3 by using an adhesive agent or the like. As exaggeratively shown in FIG. 1, a number of peripheral treatment agents 15 for damping are coated in a dot shape discontinuously at intervals to the front surface of the edge portion 13 of the diaphragm 11 by a spray coating. The peripheral treatment agents 15 are constructed by a solution in which an organic solvent of a trichloro ethane or the like is contained in a synthetic rubber or an acrylic rubber. The treatment agents 15 are set to, for example, a diameter of 0.1 to 0.5 mm and a height of 10 to 50 μm. The treatment agent 15 is coated so as to cover, for example, about 70% of the whole surface area of the edge portion 13. FIG. 2 shows frequency response characteristics of the dynamic microphone using the diaphragm 11 constructed as mentioned above. It will be understood from the diagram that in the 0° characteristics, an attenuation in a low band of 200 Hz or lower can be remarkably reduced as compared with that in frequency response characteristics shown in FIG. 6. The abnormal resonance in a middle high band is also certainly prevented by the peripheral treatment agent 15. That is, a change in stiffness by the agent 15 can be reduced and a damping effect by the agent 15 can be sufficiently obtained. Although the agent 15 has been coated in a dot shape onto the surface of the diaphragm 11 in the above embodiment, similar processings can be also performed to the rear surface of the diaphragm 11 and the agent 15 is not limited to the dot shape but can be coated in a discontinuous stripe shape.

We claim:

1. A dynamic microphone comprising:

a casing;

a diaphragm which is arranged in front of the casing and can vibrate in accordance with a vibration from a sound source and having a center dome as a center portion of the diaphragm and an edge portion as an outer peripheral portion of the center dome;

a magnet having a front surface and a rear surface, said magnet located behind the diaphragm;

a pole piece joined between the front surface of the magnet and the diaphragm;

a yoke plate joined to the rear surface of the magnet;

a voice coil which is arranged in a narrow gap between the outer peripheral surface of the pole piece and the yoke plate and is joined to the diaphragm so as to transverse a magnetic field formed by the magnet and can vibrate in an integrated manner with the diaphragm;

damping means which is constructed in a manner such that a number of peripheral treatment agents are applied to form a plurality of dots onto either one of the front surface or the back surface of the portions of the diaphragm excluding the center dome portion.

2. A dynamic microphone according to claim 1, wherein the peripheral treatment agents comprising a solution in which either one of a synthetic rubber or an acrylic rubber is mixed with an organic solvent.

3. A dynamic microphone according to claim 1 wherein the plurality of dots are in a discontinuous strip shape at intervals.

* * * * *